US009461398B2

(12) United States Patent
Nakamura

(10) Patent No.: US 9,461,398 B2
(45) Date of Patent: Oct. 4, 2016

(54) CONNECTOR

(71) Applicant: YAZAKI CORPORATION, Minato-ku, Tokyo (JP)

(72) Inventor: Masatoshi Nakamura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/534,572

(22) Filed: Nov. 6, 2014

(65) Prior Publication Data

US 2015/0064987 A1 Mar. 5, 2015

Related U.S. Application Data

(63) Continuation of application No. PCT/JP2013/002272, filed on Apr. 2, 2013.

(30) Foreign Application Priority Data

May 10, 2012 (JP) ..... 2012-108348

(51) Int. Cl.

| | |
|---|---|
| ***H01R 13/432*** | (2006.01) |
| ***H01R 13/58*** | (2006.01) |
| ***H01R 12/58*** | (2011.01) |
| ***H01R 12/70*** | (2011.01) |

(52) U.S. Cl.

CPC ..... *H01R 13/58* (2013.01); *H01R 12/585* (2013.01); *H01R 12/7064* (2013.01)

(58) Field of Classification Search

CPC ..... H01R 13/432; H01R 13/41
USPC ..... 439/746, 872, 733.1
See application file for complete search history.

(56) References Cited

U.S. PATENT DOCUMENTS 3,412,369 A * 11/1968 Benjamin Fox ..... H01R 4/14 439/748
4,701,004 A * 10/1987 Yohn ..... H01R 13/426 439/744
5,147,227 A * 9/1992 Yurko ..... H01R 13/41 439/733.1

(Continued)

FOREIGN PATENT DOCUMENTS

EP 1482594 A1 12/2004
JP 2005-135794 A 5/2005

(Continued)

OTHER PUBLICATIONS

A Japanese office action issued on Jan. 5, 2016 in the counterpart Japanese patent application.

(Continued)

*Primary Examiner* — Abdullah Riyami
*Assistant Examiner* — Thang Nguyen
(74) *Attorney, Agent, or Firm* — Mots Law, PLLC

(57) ABSTRACT

A terminal includes a terminal body, and a press-fitting protrusion protruding from the terminal body in an orthogonal direction orthogonal to a longitudinal direction of the terminal to be press-fitted in the terminal holding hole. The press-fitting protrusion includes a first protrusion portion, and a second protrusion portion disposed rearward of the first protrusion in an insertion direction and protruding father in the orthogonal direction than the first protrusion portion. The terminal has, between the first protrusion portion and the second protrusion portion, a first connection portion having a width larger than a width of the terminal body.

20 Claims, 5 Drawing Sheets

(56) References Cited

U.S. PATENT DOCUMENTS

| | | | | |
|---|---|---|---|---|
| 5,389,013 | A * | 2/1995 | Kourimsky | H01R 13/432 439/744 |
| 6,168,478 | B1 * | 1/2001 | Daoud | H01R 4/2429 439/404 |
| 6,315,615 | B1 * | 11/2001 | Raistrick | H01R 12/585 439/637 |
| 6,743,053 | B2 * | 6/2004 | Wu | H01R 13/506 439/357 |
| 8,152,572 | B1 * | 4/2012 | Liu | H01R 13/432 439/746 |
| 8,690,611 | B2 * | 4/2014 | Selvitelli | A61B 5/0416 439/729 |
| 2004/0242082 | A1 | 12/2004 | Tsuchiya | |
| 2006/0178023 | A1 * | 8/2006 | Matsumura | H01R 43/20 439/76.1 |
| 2006/0246786 | A1 * | 11/2006 | Noguchi | H01R 12/585 439/751 |
| 2007/0270001 | A1 | 11/2007 | Matsumura | |
| 2009/0156044 | A1 | 6/2009 | Mito et al. | |
| 2014/0065897 | A1 * | 3/2014 | Kida | H01R 13/41 439/889 |

FOREIGN PATENT DOCUMENTS

| | | | |
|---|---|---|---|
| JP | 2009-151940 | A | 7/2009 |
| JP | 4924247 | B2 | 4/2012 |

OTHER PUBLICATIONS

A Japanese office action issued on Oct. 20, 2015 in the counterpart Japanese patent application.

* cited by examiner

CONNECTOR

CROSS REFERENCE TO RELATED APPLICATION

This application is a Continuation of PCT Application No. PCT/JP2013/002272, filed on Apr. 2, 2013, and claims the priority of Japanese Patent Application No. 2012-108348, filed on May 10, 2012, the content of both of which is incorporated herein by reference.

BACKGROUND

1. Technical Field

The present invention relates to a connector in which a terminal is press-fitted and held in a terminal holding hole formed in a connector housing.

2. Related Art

There is known a connector which is used for connection of various devices mounted in a vehicle such as a car and is connected to, for example, a PCB (Printed Circuit Board). As a connector of this type, JP 2009-151940 A proposes a connector in which a terminal formed of a square metal wire material is press-fitted and held in a terminal holding hole formed in a connector housing.

Specifically, the above connector has a terminal including, for example, a terminal body and a plurality of press-fitting protrusions protruding outward from the terminal body so as to be press-fitted in a terminal holding hole. A connection portion is provided between the press-fitting protrusions. In general, the connection portion has a size equal to that of the terminal body. In the connector of such a type, the press-fitting protrusions are press-fitted in the terminal holding hole, whereby force of holding the terminal in the terminal holding hole can be maintained.

SUMMARY

In recent years, along with a reduction in a weight of the vehicle, a demand has arisen for a reduction in a size of the connector and, correspondingly, a reduction in the size (including a reduction in a diameter) of the terminal is being done.

However, in the above connector, simply reducing the size of the terminal leads to concentration of stress on the connection portion when the press-fitting protrusions are brought into contact with the terminal holding hole in the course of insertion of the terminal into the terminal holding hole, which may cause buckling of the connection portion.

An object of the present invention is to provide a connector capable of preventing the connection portion in which stress is concentrated upon insertion of the terminal into the terminal holding hole from being buckled.

A connector in accordance with some embodiments includes a terminal made of metal, and a connector housing having a terminal holding hole for the terminal to be press-fitted and held. The terminal includes a terminal body, and a press-fitting protrusion protruding from the terminal body in an orthogonal direction orthogonal to a longitudinal direction of the terminal to be press-fitted in the terminal holding hole. The press-fitting protrusion includes a first protrusion portion, and a second protrusion portion disposed rearward of the first protrusion in an insertion direction of the terminal into the terminal holding hole and protruding father in the orthogonal direction than the first protrusion portion. The terminal has, between the first and the second protrusion portions, a first connection portion having a width larger than a width of the terminal body.

According to the above configuration, the first connection portion has a width larger than the width of the terminal body. This can prevent the first connection portion from being buckled even if stress is concentrated on the first connection portion due to contact of the first protrusion portion and the second protrusion portion with respect to the terminal holding hole at the insertion of the terminal into the terminal holding hole. Therefore, even when the size of the terminal is reduced, the buckling of the first connection portion is unlikely to occur.

The width of the first connection portion may be larger than a thickness of the terminal body.

According to the above configuration, the width of the first connection portion is larger than the thickness of the terminal body. This further reinforces the first connection portion, with the result that the buckling of the first connection portion becomes more unlikely to occur.

The first protrusion portion may include a front protrusion, and a rear protrusion disposed rearward of the front protrusion in the insertion direction and protruding farther in the orthogonal direction than the front protrusion.

According to the above configuration, the rear protrusion protrudes farther than the front protrusion. This makes it unlikely to increase an insertion load of the terminal into the terminal holding hole, which can improve insertability of the terminal and ensure a force of holding the terminal in the terminal holding hole.

The terminal holding hole may include a front protrusion holding portion for the front protrusion to be press-fitted and held, a rear protrusion holding portion for the rear protrusion to be press-fitted and held, the rear protrusion holding portion being disposed rearward of the front protrusion holding portion in the insertion direction, a second protrusion accommodating portion configured to accommodate the second protrusion portion with the front protrusion and the rear protrusion passed through the second protrusion accommodating portion, the second protrusion accommodating portion being disposed rearward of the rear protrusion holding portion in the insertion direction, a front step portion provided between the front protrusion holding portion and the rear protrusion holding portion, and a rear step portion provided between the rear protrusion holding portion and the second protrusion accommodating portion.

According to the above configuration, the front step portion is formed between the front protrusion holding portion and rear protrusion holding portion, and the rear step portion is formed between the rear protrusion holding portion and second protrusion accommodating portion. With this configuration, spaces are formed rearward of the front step portion and rear step portion in the insertion direction when the terminal is press-fitted and held in the terminal holding hole, which makes it easy for the peripheral wall of the terminal holding hole to be deformed. As a result, the insertability of the terminal is further improved.

The connector may further include a second connection portion provided between the front protrusion and the rear protrusion. A width of the front protrusion holding portion may be equal to the width of the first connection portion, and a width of the rear protrusion holding portion may be equal to a width of the second connection portion.

According to the above configuration, the width of the front protrusion holding portion is equal to the width of the first connection portion, and the width of the rear protrusion holding portion is equal to the width of the second connection portion. This makes it easier to ensure the force of holding the terminal in the terminal holding hole.

According to the embodiments of the present invention, there can be provided a connector capable of preventing the connection portion in which stress is concentrated upon insertion of the terminal into the terminal holding hole from being buckled.

DETAILED DESCRIPTION

An embodiment of a connector according to the present invention will be described with reference to the drawings. In the following descriptions of the drawings, the same or similar portions are assigned with the same or similar reference symbols. It should be noted that each drawing is a schematic diagram, and may represent different dimensional ratios and the like from an actual dimensional ratios. Hence, specific dimensions and the like should be determined in consideration of the following descriptions. Furthermore, different drawings include elements which have different dimensional relations and ratios.

Configuration of Connector

Figure 1:
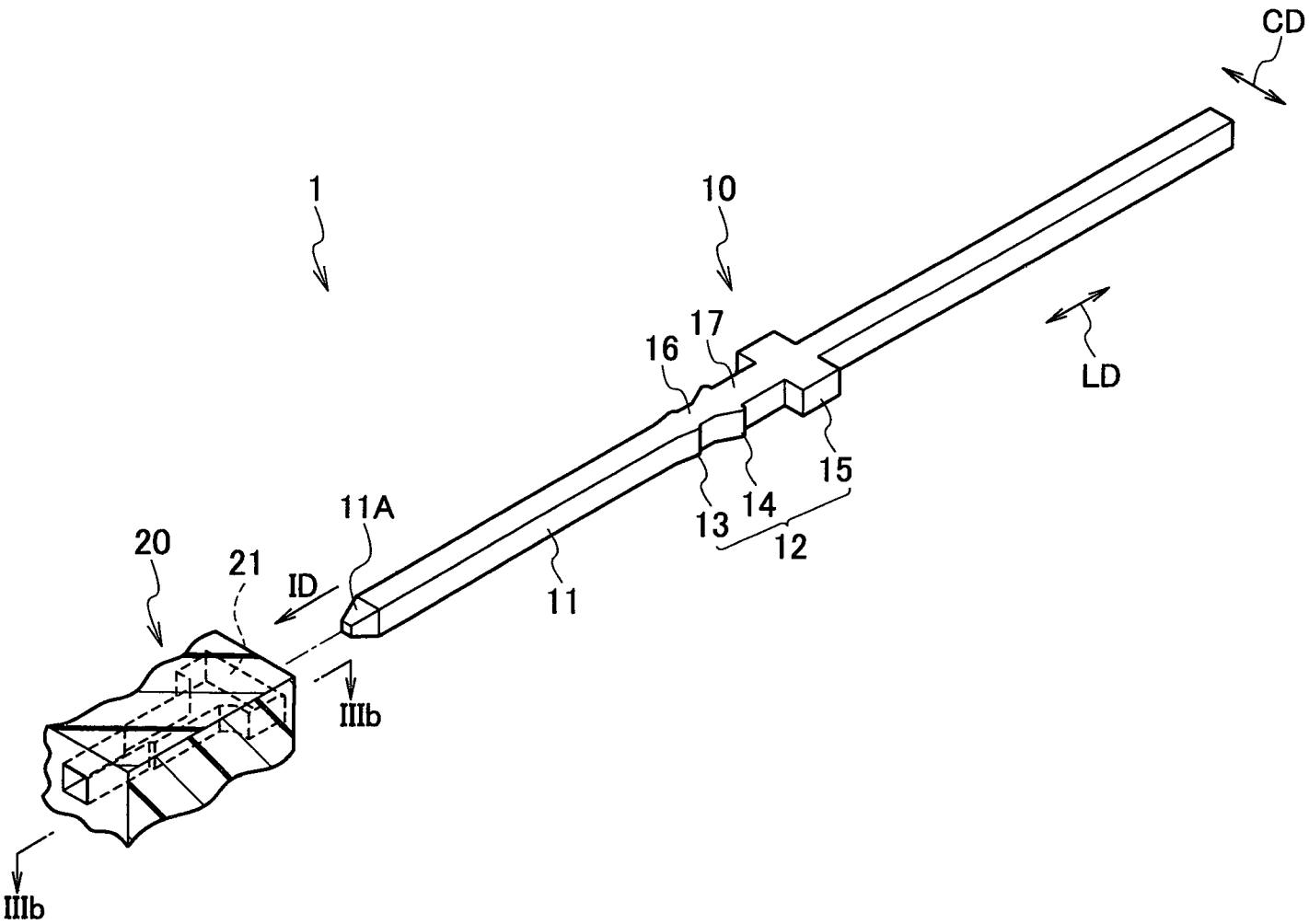
FIG. 1 is a perspective view illustrating a connector according to an embodiment of the present invention.
Figure 2A:
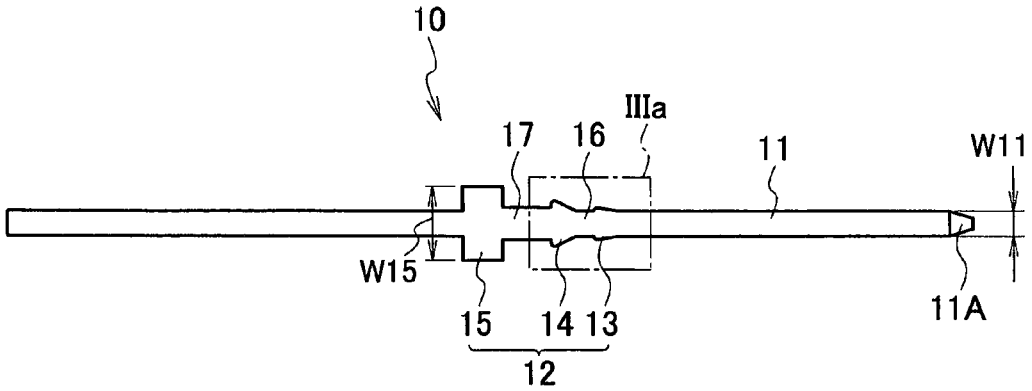
FIG. 2A is a plan view illustrating the connector according to the embodiment of the present invention.
Figure 2B:
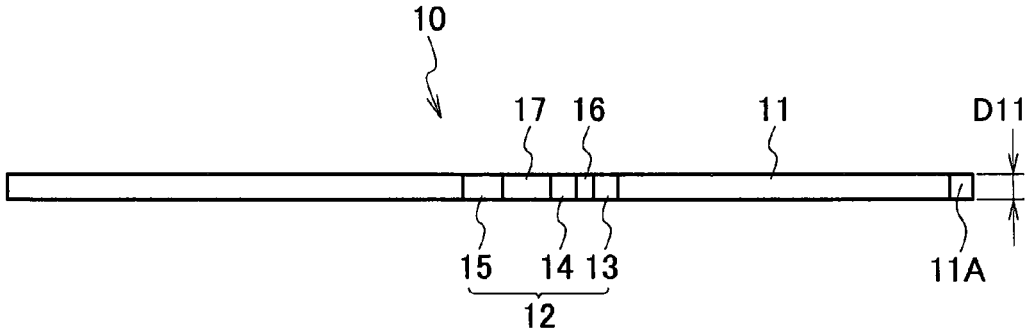
FIG. 2B is a side view illustrating the connector according to the embodiment of the present invention.
Figure 3A:
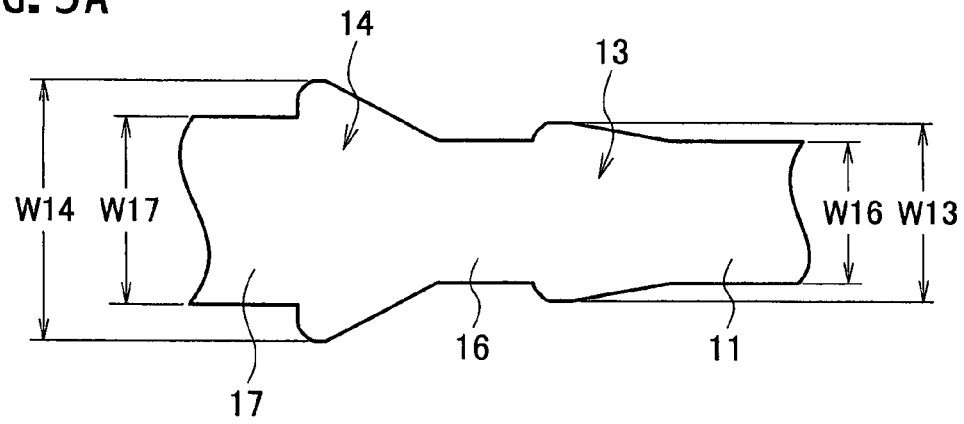
FIG. 3A is an enlarged view of a part IIIa of FIG. 2A.
Figure 3B:
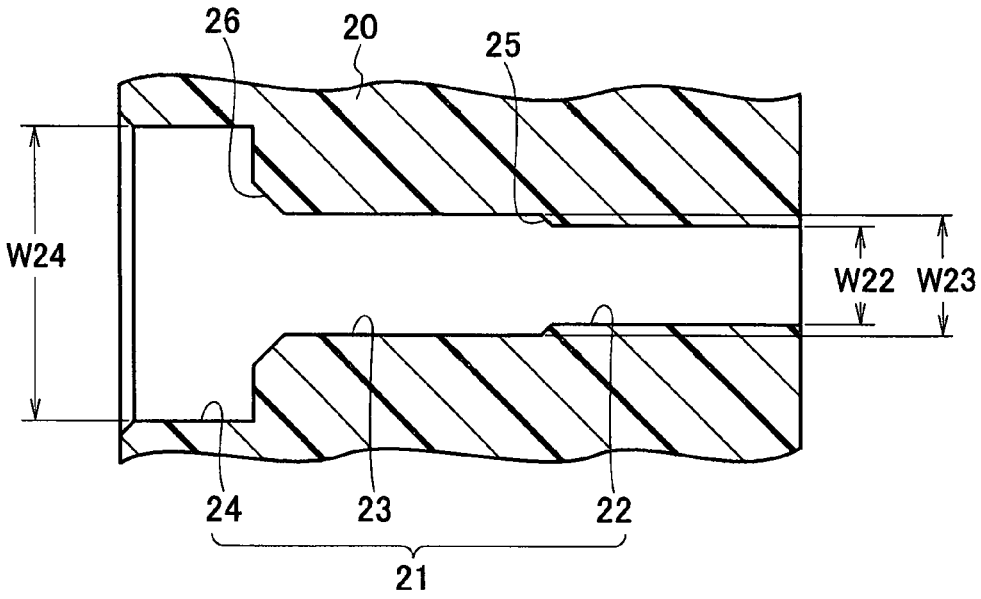
FIG. 3B is a cross-sectional view taken along a line IIIb-IIIb of FIG. 1.

First, a configuration of a connector 1 according to the present embodiment will be described with reference to the drawings. FIG. 1 is a perspective view illustrating the connector 1 according to the present embodiment. FIG. 2A is a plan view illustrating the connector 1 according to the present embodiment, and FIG. 2B is a side view illustrating the connector 1 according to the present embodiment. FIG. 3A is an enlarged view of a part IIIa of FIG. 2A, and FIG. 3B is a cross-sectional view taken along a line IIIb-IIIb of FIG. 1.

As illustrated in FIG. 1 to FIG. 3B, the connector 1 is used for connection of various devices mounted in a vehicle such as a car and is connected to, for example, a PCB (Printed Circuit Board). The connector 1 includes a terminal 10 formed of a square metal wire material and a connector housing 20 having a terminal holding hole 21 in which the terminal 10 is press-fitted and held. The terminal 10 is not necessarily formed of the square wire material, but only needs to be formed of a metal.

Configuration of Terminal

As illustrated in FIG. 1 to FIG. 3B, the terminal 10 is obtained by applying copper ground plating or a nickel ground plating to a surface of a copper alloy such as brass serving as a base material. The terminal 10 has an elongated shape having a rectangular cross section and assumes substantially a symmetric appearance as viewed from above (see FIG. 2A).

The terminal 10 has a terminal body 11 and a press-fitting protrusion 12 protruding from the terminal body 11 in an orthogonal direction CD (width direction, in the present embodiment) orthogonal to a longitudinal direction LD of the terminal 10 so as to be press-fitted to a terminal holding hole 21.

The press-fitting protrusion 12 is constituted by a front protrusion 13 and a rear protrusion 14 which collectively serve as a first protrusion portion and each of which has substantially a triangular shape as viewed from above (see FIG. 2A) and a press-fitting shoulder portion 15 which serves as a second protrusion portion.

The front protrusion 13 is formed frontward of the rear protrusion 14 in an insertion direction ID of the terminal 10 into the terminal holding hole 21. The rear protrusion 14 protrudes farther in the orthogonal direction CD than the front protrusion 13. The press-fitting shoulder portion 15 is formed rearward of the front protrusion 13 and rear protrusion 14 in the insertion direction ID of the terminal 10 and protrudes farther in the orthogonal direction CD than the front protrusion 13 and rear protrusion 14.

A connection portion 16 serving as a second connection portion is formed between the front protrusion 13 and rear protrusion 14. A connection portion 17 serving as a first connection portion is formed between the rear protrusion 14 and press-fitting shoulder portion 15.

The connection portion 16 has a size equal to that of the terminal body 11. That is, a width W16 of the connection portion 16 (see FIG. 3A) is equal to a width W11 (see FIG. 2A) of the terminal body 11. A thickness of the connection portion 16 is equal to a thickness D11 (see FIG. 2B) of the terminal body 11.

The connection portion 17 has a width larger than the width W11 of the terminal body 11. That is, a width W17 of the connection portion 17 is larger than the width W11 of the terminal body 11 and is larger than the thickness D11 of the terminal body 11. A thickness of the connection portion 17 is equal to the thickness D11 of the terminal body 11.

Configuration of Connector Housing

As illustrated in FIG. 1 and FIG. 3B, the connector housing 20 is formed of a resin, etc., and is configured to fix and hold the terminal 10 press-fitted in the terminal holding hole 21. Although only a part of the connector housing 20 is illustrated in the drawings, the connector housing 20 is configured to be able to be fitted with and detached from a mating connector.

The terminal holding hole 21 formed in the connector housing 20 extends along the insertion direction ID (i.e., longitudinal direction LD of the terminal 10) of the terminal 10. As illustrated in FIG. 3B, the terminal holding hole 21 is constituted by a front protrusion holding portion 22 and a rear protrusion holding portion 23 which collectively serve as a first protrusion accommodating portion and a shoulder accommodating portion 24 which serves as a second protrusion accommodating portion. The front protrusion holding portion 22 holds the front protrusion 13 press-fitted therein. The rear protrusion holding portion 23 holds the rear protrusion 14 press-fitted therein. The shoulder accommodating portion 24 allows the front protrusion 13 and rear protrusion 14 to pass therethrough and accommodates the press-fitting shoulder portion 15.

A width W22 of the front protrusion holding portion 22 is smaller than a width W13 of the front protrusion 13 and coincides with (is equal to) the width W16 of the connection portion 16. A width W23 of the rear protrusion holding portion 23 is smaller than a width W14 of the rear protrusion 14 and coincides with (is equal to) the width W13 of the front protrusion 13 and width W17 of the connection portion 17. A width W24 of the shoulder accommodating portion 24 is larger than a width W15 of the press-fitting shoulder portion 15. Thicknesses of the front protrusion holding portion 22, rear protrusion holding portion 23, and shoulder accommodating portion 24 are respectively equal to the thickness D11 of the terminal body 11.

The above "coincidence" is nominal coincidence and, in the present embodiment, the width W22 of the front protrusion holding portion 22 is slightly larger (by the size of a clearance) than the width W16 of the connection portion 16. Further, the width W23 of the rear protrusion holding portion 23 is slightly larger than the width W17 of the connection portion 17.

A front step portion 25, which is on a front side of the terminal 10 in the insertion direction ID of the terminal 10, is formed between the front protrusion holding portion 22 and rear protrusion holding portion 23. A rear step portion 26, which is rearward of the front step portion 25 in the insertion direction ID of the terminal 10, is formed between the rear protrusion holding portion 23 and shoulder accommodating portion 24. The front step portion 25 is formed by a slope inclined relative to the orthogonal direction CD. The rear step portion 26 is formed by a slope inclined relative to the orthogonal direction CD.

Assembly Process of Terminal and Connector Housing

Figure 4A:
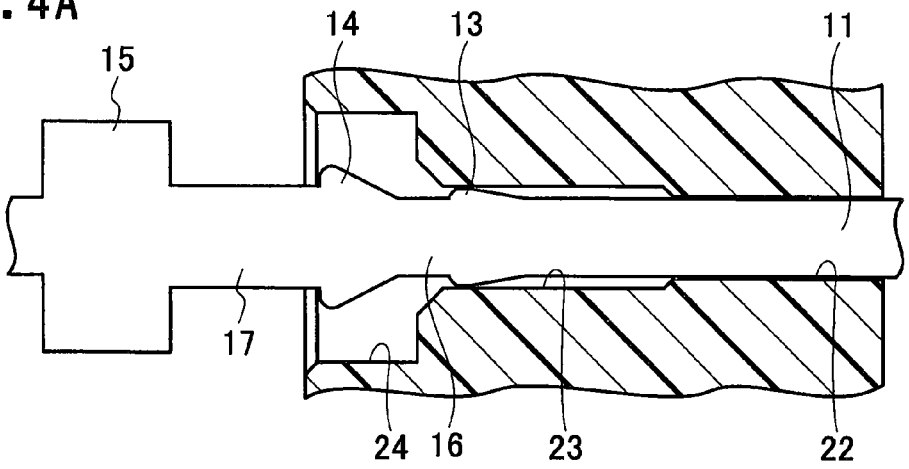
FIG. 4A is a cross-sectional view for explaining an assembly process of a terminal and a connector housing according to the present embodiment.
Figure 4B:
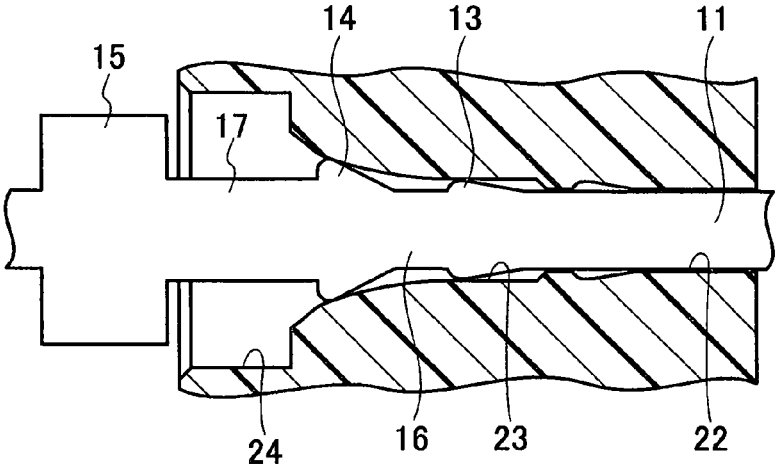
FIG. 4B is a cross-sectional view for explaining an assembly process of the terminal and connector housing according to the present embodiment.
Figure 4C:
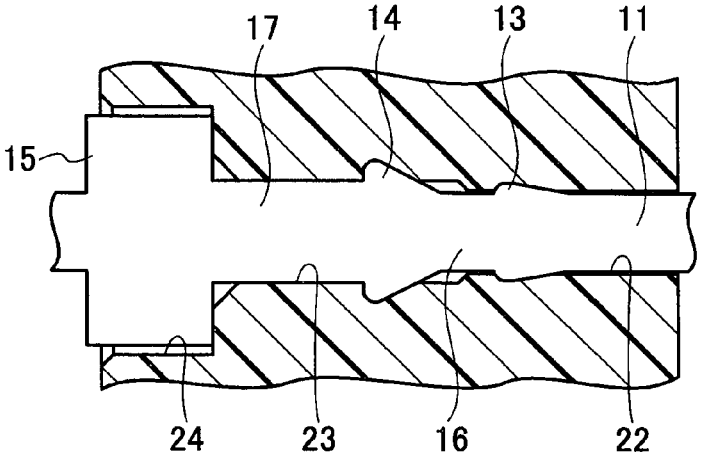
FIG. 4C is a cross-sectional view for explaining an assembly process of the terminal and connector housing according to the present embodiment.
Figure 5:
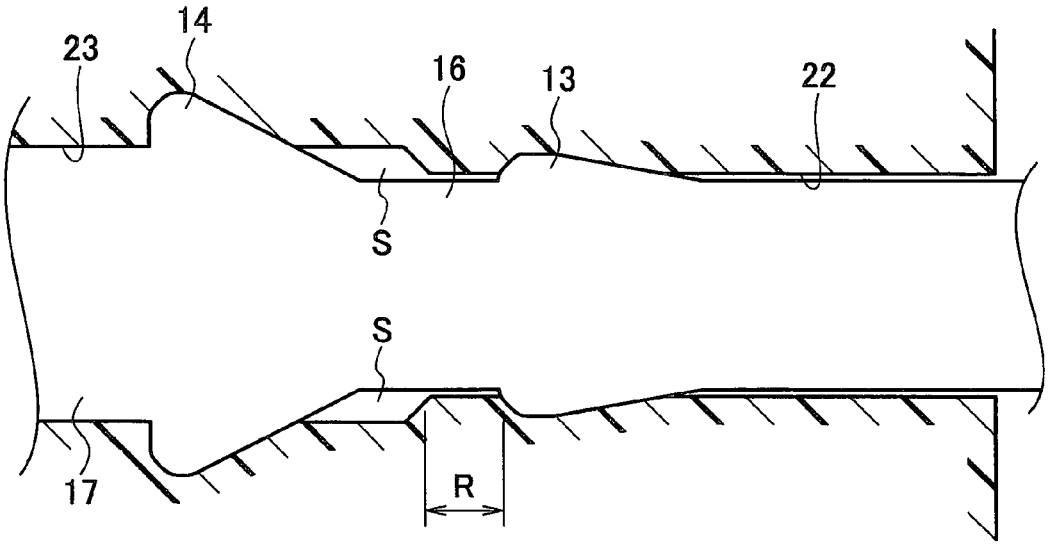
FIG. 5 is a partially enlarged view of FIG. 4C.

The following describes an assembly process of the terminal 10 and housing connector 20 with reference to the drawings. FIGS. 4A to 4C are cross-sectional views for explaining the assembly process of the terminal 10 and housing connector 20 according to the present embodiment. FIG. 5 is a partially enlarged view of FIG. 4C.

First, the terminal 10 is inserted, from a leading end 11A side of the terminal body 11, into the terminal holding hole 21 formed in the connector housing 20. At this time, the terminal body 11 is inserted through the shoulder accommodating portion 24, rear protrusion holding portion 23, and front protrusion holding portion 22 in this order.

More specifically, as illustrated in FIG. 4A, when the terminal 10 is inserted into the terminal holding hole 21, the front protrusion 13 is inserted through the shoulder accommodating portion 24 and positioned in the rear protrusion holding portion 23, and the rear protrusion 14 is positioned in the shoulder accommodating portion 24. At this time, the width W23 of the rear protrusion holding portion 23 coincides with the width W13 of the front protrusion 13 (see FIGS. 2A, 2B, 3A, and 3B), so that an insertion load of the terminal 10 is not increased.

Subsequently, as illustrated in FIG. 4B, when the terminal 10 is further inserted into the terminal holding hole 21, the rear protrusion 14 is press-fitted in the rear protrusion holding portion 23 in a state where the front protrusion 13 is positioned in the rear protrusion holding portion 23. At this time, the front protrusion 13 is not press-fitted in the front protrusion holding portion 22 and, thus, a stroke (an increase in insertion load) at the press-fitting of the terminal 10 is reduced, which can prevent the insertion load of the terminal 10 from being increased.

Subsequently, as illustrated in FIG. 4C, when the terminal 10 is still further inserted into the terminal holding hole 21, the front protrusion 13 is press-fitted in the front protrusion holding portion 22, the rear protrusion 14 continues to be press-fitted in the rear protrusion holding portion 23, and the press-fitting shoulder portion 15 is positioned in the shoulder accommodating portion 24.

At this time, as illustrated in FIG. 5, there occurs a space S rearward of the front protrusion 13 in the insertion direction ID to make it easy for the connector housing 20 to be deformed and, thereafter, the front protrusion holding portion 22 is restored after the passing of the front protrusion 13, whereby the front protrusion 13 is press-fitted and held between inner surfaces of the front protrusion holding portion 22. Thus, force of holding the terminal 10 in the terminal holding hole 21 can be ensured.

In addition, the width W17 of the connection portion 17 is larger than the width W11 of the terminal body 11 and larger than the thickness D11 of the terminal body 11, so that it is possible to prevent the connection portion 17 from being buckled due to stress concentrated thereon. Since the connection portion 16 is positioned in the front protrusion holding portion 22, the connection portion 16 is prevented from being buckled.

Functions and Effects

In the above embodiment, the connection portion 17 has a width larger than the width W11 of the terminal body 11. This can prevent the connection portion 17 from being buckled even if stress is concentrated on the connection portion 17 due to contact of the front protrusion 13 and rear protrusion 14 with respect to the terminal holding hole 21 at the insertion of the terminal 10 into the terminal holding hole 21. Therefore, even when the size of the terminal 10 is reduced, the buckling of the connection portion 17 is unlikely to occur.

In the present embodiment, the width W17 of the connection portion 17 is larger than the thickness D11 of the terminal body 11. This further reinforces the connection portion 17, with the result that the buckling of the connection portion 17 becomes more unlikely to occur.

In the present embodiment, the rear protrusion 14 protrudes farther in the orthogonal direction CD than the front protrusion 13. This makes it unlikely to increase the insertion load of the terminal 10 into the terminal holding hole 21, which can improve insertability of the terminal 10 and ensure the force of holding the terminal 10 in the terminal holding hole 21.

In the present embodiment, the front step portion 25 is formed between the front protrusion holding portion 22 and rear protrusion holding portion 23, and the rear step portion 26 is formed between the rear protrusion holding portion 23 and shoulder accommodating portion 24. With this configuration, the spaces S are formed rearward of the front step portion 25 and rear step portion 26 in the insertion direction ID when the terminal 10 is press-fitted and held in the terminal holding hole 21, which makes it easy for the peripheral wall of the terminal holding hole 21 to be deformed. As a result, the insertability of the terminal 10 is further improved.

Preferably, a distance R (so-called lap amount) over which the front protrusion 13 moves in the front protrusion holding portion 22 is as long as possible (see FIG. 5). When the distance R is long, the insertability of the terminal 10 is reduced, whereas a shear amount is increased to make it easy to ensure the force of holding the terminal 10 in the terminal holding hole 21. That is, by setting the distance R over which the front protrusion 13 moves in the front protrusion holding portion 22, the insertability of the terminal 10 and the force of holding the terminal 10 in the terminal holding hole 21 can be controlled.

In the present embodiment, the width W22 of the front protrusion holding portion 22 coincides with the width W16 of the connection portion 16, and the width W23 of the rear protrusion holding portion 23 coincides with the width W17 of the connection portion 17. This makes it easier to ensure the force of holding the terminal 10 in the terminal holding hole 21.

Other Embodiments

As described above, the scope of the present invention has been disclosed through the embodiment of the present invention. However, it should be understood that those descriptions and drawings constituting a part of the present disclosure do not limit the present invention. From the present disclosure, various alternative embodiments, examples, and operational technologies will become apparent to those skilled in the art.

For example, the embodiment of the present invention may be modified as follows. Specifically, although it has been described that the width W17 of the connection portion 17 is larger than the thickness D11 of the terminal body 11, the present invention is not limited to this, and the width W17 of the connection portion 17 may be equal to or smaller than the thickness D11 of the terminal body 11.

Further, although it has been described that the first protrusion portion includes the two protrusions: front protrusion 13 and rear protrusion 14, the present invention is not limited to this, and the first protrusion portion may include three or more protrusions. Even in this case, each protrusion can be made to gradually protrude in the orthogonal direction from its front side to its rear side in the insertion direction ID of the terminal 10. Further, although it has been described that the rear protrusion 14 protrudes farther than the front protrusion 13, the present invention is not limited to this, and the protruding amounts of the rear protrusion 14 and front protrusion 13 may be equal to each other.

Further, it has been described that the front step portion 25 is formed by the slope inclined relative to the orthogonal direction CD, and the rear step portion 26 is formed by the slope inclined relative to the orthogonal direction CD. However, the present invention is not limited to this, and a configuration may be adopted in which the front and rear step portions 25 and 26 may each be formed by a surface parallel to the orthogonal direction CD, or in which one of the front and rear step portions 25 and 26 is formed by the slope inclined relative to the orthogonal direction CD and the other one thereof is formed by the surface parallel to the orthogonal direction CD.

Further, the width W22 of the front protrusion holding portion 22 and width W23 of the rear protrusion holding portion 23 are not limited to those described in the above embodiment, but may appropriately be set.

As described above, the present invention obviously includes various embodiments and the like not described above. Accordingly, the technical scope of the present invention is determined only by the invention elements according to the scope of claims from the viewpoint of the above explanation.

What is claimed is:

1. A connector comprising:

a terminal made of metal; and a connector housing having a terminal holding hole for the terminal to be press-fitted and held, wherein the terminal includes a terminal body, and a press-fitting protrusion protruding from the terminal body in an orthogonal direction orthogonal to a longitudinal direction of the terminal to be press-fitted in the terminal holding hole, wherein the press-fitting protrusion includes a first protrusion portion, and a second protrusion portion disposed rearward of the first protrusion in an insertion direction of the terminal into the terminal holding hole and protruding farther in the orthogonal direction than the first protrusion portion, wherein the terminal has, between the first and the second protrusion portions, a first connection portion having a width larger than a width of the terminal body, and wherein the first protrusion portion includes a front protrusion, a rear protrusion disposed rearward of the front protrusion in the insertion direction and protruding farther in the orthogonal direction than the front protrusion, and a second connection portion between the front protrusion and the rear protrusion, the second connection portion having a width equal to the width of the terminal body and having a thickness equal to a thickness of the terminal body in the orthogonal direction wherein the terminal holding hole includes a front protrusion holding portion for the front protrusion to be press-fitted and held, a rear protrusion holding portion for the rear protrusion to be press-fitted and held, the rear protrusion holding portion being disposed rearward of the front protrusion holding portion in the insertion direction, a second protrusion accommodating portion configured to accommodate the second protrusion portion with the front protrusion and the rear protrusion passed through the second protrusion accommodating portion, the second protrusion accommodating portion being disposed rearward of the rear protrusion holding portion in the insertion direction, a front step portion provided between the front protrusion holding portion and the rear protrusion holding portion, a rear step portion provided between the rear protrusion holding portion and the second protrusion accommodating portion, and wherein a width of the second protrusion accommodating portion is larger than a width of the second protrusion portion.

2. The connector according to claim 1, wherein the front step portion comprises a slope inclined relative to the orthogonal direction, and the rear step portion comprises a slope inclined relative to the orthogonal direction.

3. The connector according to claim 1, wherein at least one of the front step portion and the rear step portion comprises a surface parallel relative to the orthogonal direction.

4. The connector according to claim 1, wherein the terminal is positioned in inserted relation into the terminal holding hole such that the front protrusion is positioned in inserted relation through the second protrusion accommodating portion to be positioned in the rear protrusion holding portion, the rear protrusion is positioned in the second protrusion accommodating portion and the width of the rear protrusion holding portion coincides with the width of the front protrusion.

5. The connector according to claim 4, wherein the terminal is further positioned in inserted relation into the terminal holding hole such that the rear protrusion is positioned in press-fit relation in the rear protrusion holding portion in a state where the front protrusion is positioned in the rear protrusion holding portion but is not positioned in press-fit relation in the front protrusion holding portion.

6. The connector according to claim 5, wherein the terminal is still further positioned in inserted relation into the terminal holding hole such that the front protrusion is positioned in press-fit relation in the front protrusion holding portion, the rear protrusion is positioned in press-fit relation in the rear protrusion holding portion, and the second protrusion portion is positioned in the second protrusion accommodating portion.

7. The connector according to claim 6, wherein a space is provided rearward of the front protrusion in the insertion direction such that the connector housing is enabled to be deformed and the front protrusion holding portion is restored such that the front protrusion is held in press fit relation between inner surfaces of the front protrusion holding portion.

8. The connector according to claim 6, wherein a distance over which the front protrusion moves in the front protrusion holding portion is set as long as possible to control a force of holding the terminal in the terminal holding hole.

9. The connector according to claim 1, wherein the first protrusion portion include three or more protrusions.

10. The connector according to claim 1, wherein the terminal is formed of a square metal wire material.

11. The connector according to claim 1, wherein the terminal comprises a copper alloy base material having a copper ground plating or a nickel ground plating applied to a surface of a copper alloy base material.

12. The connector according to claim 1, wherein the front protrusion and the rear protrusion of the first protrusion portion each has a substantially triangular shape.

13. The connector according to claim 1, wherein the width of the first connection portion is larger than the thickness of the terminal body.

14. The connector according to claim 1, wherein a width of the front protrusion holding portion is equal to a width of the second connection portion, and a width of the rear protrusion holding portion is equal to a width of the first connection portion.

15. The connector according to claim 1, wherein a width of the front protrusion holding portion is smaller than a width of the front protrusion, and a width of the rear protrusion holding portion is smaller than a width of the rear protrusion and is equal to the width of the front protrusion.

16. A connector comprising:

a terminal made of metal; and a connector housing having a terminal holding hole for the terminal to be press-fitted and held, wherein the terminal includes a terminal body, and a press-fitting protrusion protruding from the terminal body in an orthogonal direction orthogonal to a longitudinal direction of the terminal to be press-fitted in the terminal holding hole, wherein the press-fitting protrusion includes a first protrusion portion, and a second protrusion portion disposed rearward of the first protrusion in an insertion direction of the terminal into the terminal holding hole and protruding farther in the orthogonal direction than the first protrusion portion, wherein the terminal has, between the first and the second protrusion portions, a first connection portion having a width larger than a width of the terminal body, and wherein the first protrusion portion includes a front protrusion, a rear protrusion disposed rearward of the front protrusion in the insertion direction and protruding farther in the orthogonal direction than the front protrusion, and a second connection portion between the front protrusion and the rear protrusion, the second connection portion having a width equal to the width of the terminal body and having a thickness equal to a thickness of the terminal body in the orthogonal direction wherein the terminal holding hole includes a front protrusion holding portion for the front protrusion to be press-fitted and held, a rear protrusion holding portion for the rear protrusion to be press-fitted and held, the rear protrusion holding portion being disposed rearward of the front protrusion holding portion in the insertion direction, a second protrusion accommodating portion configured to accommodate the second protrusion portion with the front protrusion and the rear protrusion passed through the second protrusion accommodating portion, the second protrusion accommodating portion being disposed rearward of the rear protrusion holding portion in the insertion direction, a front step portion provided between the front protrusion holding portion and the rear protrusion holding portion, a rear step portion provided between the rear protrusion holding portion and the second protrusion accommodating portion, and wherein thicknesses of the front protrusion holding portion, the rear protrusion holding portion, and the second protrusion accommodating portion are respectively equal to the thickness of the terminal body.

17. The connector according to claim 16, wherein the width of the first connection portion is larger than the thickness of the terminal body.

18. The connector according to claim 16, wherein a width of the front protrusion holding portion is equal to a width of the second connection portion, and a width of the rear protrusion holding portion is equal to a width of the first connection portion.

19. A connector comprising:

a terminal made of metal; and a connector housing having a terminal holding hole for the terminal to be press-fitted and held, wherein the terminal includes a terminal body, and a press-fitting protrusion protruding from the terminal body in an orthogonal direction orthogonal to a longitudinal direction of the terminal to be press-fitted in the terminal holding hole, wherein the press-fitting protrusion includes a first protrusion portion, and a second protrusion portion disposed rearward of the first protrusion in an insertion direction of the terminal into the terminal holding hole and protruding farther in the orthogonal direction than the first protrusion portion, wherein the terminal has, between the first and the second protrusion portions, a first connection portion having a width larger than a width of the terminal body, and wherein the first protrusion portion includes a front protrusion, a rear protrusion disposed rearward of the front protrusion in the insertion direction and protruding farther in the orthogonal direction than the front protrusion, and a second connection portion between the front protrusion and the rear protrusion, the second connection portion having a width equal to the width of the terminal body and having a thickness equal to a thickness of the terminal body in the orthogonal direction wherein the terminal holding hole includes a front protrusion holding portion for the front protrusion to be press-fitted and held, a rear protrusion holding portion for the rear protrusion to be press-fitted and held, the rear protrusion holding portion being disposed rearward of the front protrusion holding portion in the insertion direction, a second protrusion accommodating portion configured to accommodate the second protrusion portion with the front protrusion and the rear protrusion passed through the second protrusion accommodating portion, the second protrusion accommodating portion being disposed rearward of the rear protrusion holding portion in the insertion direction, a front step portion provided between the front protrusion holding portion and the rear protrusion holding portion, a rear step portion provided between the rear protrusion holding portion and the second protrusion accommodating portion, and wherein a width of the front protrusion holding portion is slightly larger than a width of the first connection portion, and a width of the rear protrusion holding portion is slightly larger than a width of the second connection portion.

20. The connector according to claim 19, wherein the width of the first connection portion is larger than the thickness of the terminal body.

* * * * *